US006112551A

United States Patent [19]

Noda

[11] Patent Number: 6,112,551

[45] Date of Patent: Sep. 5, 2000

[54] SETTING METALLIC PARTS FOR SETTING A FACET CUT PRECIOUS STONE

[75] Inventor: Shinji Noda, Saitama, Japan

[73] Assignee: Irikura Precious Metal Craft Ltd., Tokyo, Japan

[21] Appl. No.: 09/149,119

[22] Filed: Sep. 9, 1998

[51] Int. Cl.[7] ..... A44C 17/02

[52] U.S. Cl. ..... 63/26; 63/27

[58] Field of Search ..... 63/26, 27, 28, 63/34

[56] References Cited

U.S. PATENT DOCUMENTS

| | | | |
|---|---|---|---|
| 283,864 | 8/1883 | Covell | 63/26 |
| 832,887 | 10/1906 | Wittstein | 63/27 |
| 1,211,240 | 1/1917 | Ryan | 63/26 |
| 2,377,222 | 5/1945 | Fruth | 63/26 X |
| 5,090,217 | 2/1992 | Beber et al. | 63/27 |
| 5,680,776 | 10/1997 | Shenhav | 63/26 |
| 5,755,117 | 5/1998 | Shenhav | 63/26 |
| 5,974,831 | 11/1999 | Afuku et al. | 63/26 |
| 6,023,947 | 2/2000 | Afuku et al. | 63/26 |

FOREIGN PATENT DOCUMENTS

| | | | |
|---|---|---|---|
| 451013 | 1/1913 | France | 63/26 |
| 52-30574 | 3/1977 | Japan | 63/26 |
| 463129 | 6/1935 | United Kingdom | 63/26 |
| 2026303 | 2/1980 | United Kingdom | 63/26 |

*Primary Examiner*—Terry Lee Melius
*Assistant Examiner*—Andrea Chop
*Attorney, Agent, or Firm*—Wenderoth, Lind & Ponack, L.L.P.

[57] ABSTRACT

A setting of metallic parts for setting a facet cut precious stone comprises a prong portion for pressing the crown of the facet cut precious stone or the crown and the table of the facet cut precious stone from above so as to be in pressure-contact therewith. The setting also includes a concave-shaped inserting portion in pressure-contact with the culet of the facet cut precious stone from below. The facet cut precious stone is held on one side of the setting, and a heated and dissolved thermoplastic agent is flowed into a pressure contact-surface of the prong portion of the setting of metallic parts. Subsequently the thermoplastic agent is cooled and solidified, thereby to bring the setting metallic parts into close contact with the facet cut precious stone.

7 Claims, 4 Drawing Sheets

SETTING METALLIC PARTS FOR SETTING A FACET CUT PRECIOUS STONE

BACKGROUND OF THE INVENTION

This invention relates to a setting of metallic parts for setting a facet cut precious stone to jewelry such as a pendant, a ring, a pierced earring, an earring, and further relates to a method of setting a facet cut precious stone by setting metallic parts to jewelry.

In a conventional method of setting a facet cut precious stone to jewelry by using setting metallic parts, more than one prong was necessary to press the crown of the facet cut precious stone from above.

Also, the girdle of the facet cut precious stone was held by a ring-shape sheet from below.

On the other hand, as shown in FIGS. 1 and 2, a setting of metallic parts for setting a facet cut precious stone may comprise one prong portion for pressing the crown of the facet cut precious stone or the crown and the table of the facet cut precious stone, and one concave-shaped inserting portion for holding the culet in the vicinity of the facet cut precious stone.

Compared to the conventional setting method, the latter setting method has an advantage that much more light enters the facet cut precious stone since the upper facets of the facet cut precious stone are not being covered by many prongs, and the precious stone can maintain its brightness and beauty after the setting.

However, the latter setting of metallic parts has a disadvantage in the respect of it's strength. Since the facet cut precious stone is held by only one prong portion and one inserting portion from one side of the stone, when some accident happens and some pulling-apart force is added to the setting metallic parts, the prong portion is easily opened and the facetted precious stone may fall off.

Also, since the cutting of the facet cut precious stone is usually done by a crraftsman's hands, the proportions of each facet cut of the precious stones are not exactly the same proportion even in the same cutting style of the facet cut precious stone. On the other hand, jewelry parts are mainly manufactured by the casting method or the press cutting method in a factory. Therefore, the setting of metallic parts usually has a uniform proportion in the same style of the setting of metallic parts. Thus, a gap may be formed between the facets of the facet cut precious stone and the pressure contact-surface of the setting metallic parts. Consequently, correction work is needed to eliminate the gap and to contact the pressure contact-surface of the setting metallic parts and the facets of the facet cut precious stone closely, which has been done by cutting or polishing of each setting metallic parts by craftsman's hands.

SUMMARY OF THE INVENTION

Accordingly, the present invention has been developed with a view to eliminate such problems in the prior setting of metallic parts for setting a facet cut precious stone comprising one prong portion and one concave-shaped inserting portion which holds the facet cut precious stone from one side. It is an object of the present invention to provide a setting of metallic parts for setting a facet cut precious stone, and the setting comprises one prong portion and one concave-shaped inserting portion which holds the facet cut precious stone from one side. The setting of metallic parts has more strength so that the prong portion is not opened easily and so that the facet cut precious stone does not fall off. In addition, a method of setting a facet cut precious stone by the setting of metallic parts is provided as well.

Also, it is an object of the present invention to provide a setting of metallic parts for setting a facet cut precious stone, and the setting comprises one prong portion and one concave-shaped inserting portion which closely contacts all facet cut precious stones in the same cutting style, so that the correction work is not needed.

BRIEF DESCRIPTION OF THE DRAWINGS

The object and features of the present invention will become more readily apparent from the following detailed description of the preferred embodiment taken in conjunction with the accompanying drawings, in which.

DETAILED DESCRIPTION OF THE INVENTION

Figure 1:
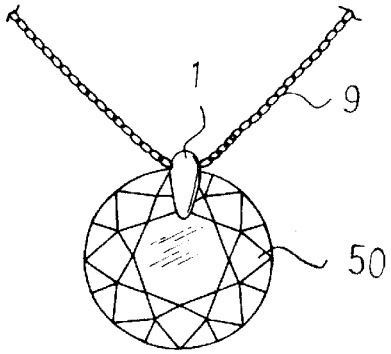
FIG.1 PRIOR ART
FIG. 1 is a plan view showing one embodiment of a prior setting of metallic parts for setting a facet cut precious stone, in which the setting comprises a prong portion and a concave-shaped inserting portion.
Figure 2:
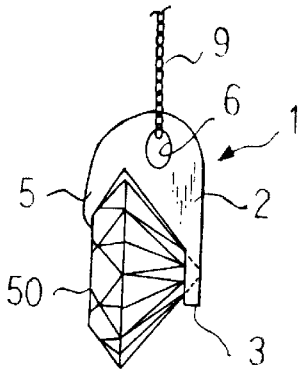
FIG.2 PRIOR ART
FIG. 2 is a side view showing one example of a prior setting of metallic parts for setting a facet cut precious stone, in which the setting comprises a prong portion and a concave-shaped inserting portion.

Referring to the drawings, a description will be made herein below of a preferred embodiment of the present invention.

Figure 3:
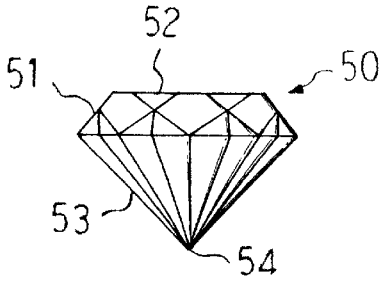
FIG. 3 is a side view showing one example of a facet cut precious stone which is held by the setting of metallic parts in this invention.

FIG. 3 is a side view showing one example of a cutting style of a facet cut precious stone which is held by the setting of metallic parts of this invention. As shown FIG. 3, a facet cut precious stone 50 comprises an upper half portion with a substantially truncated cone shape having a crown 51, consisting of a plurality of side facets, and a plane-shaped table 52 formed on the top of the crown 51. The stone 50 also includes a lower half portion with a substantially truncated cone shape having a pavilion 53, formed by a plurality of side facets, and an acute culet 54 formed at the tip of the pavilion. The facetted cut precious stone 50 may be a diamond, a ruby, a sapphire, or other precious stone, semi-precious stone, or a synthetic gemstone.

Figure 4:
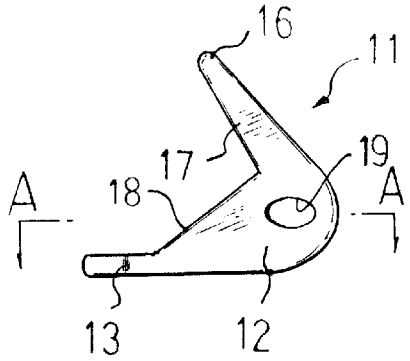
FIG. 4 is a side view showing one embodiment of a setting of metallic parts for setting a facet cut precious stone in this invention.
Figure 5:
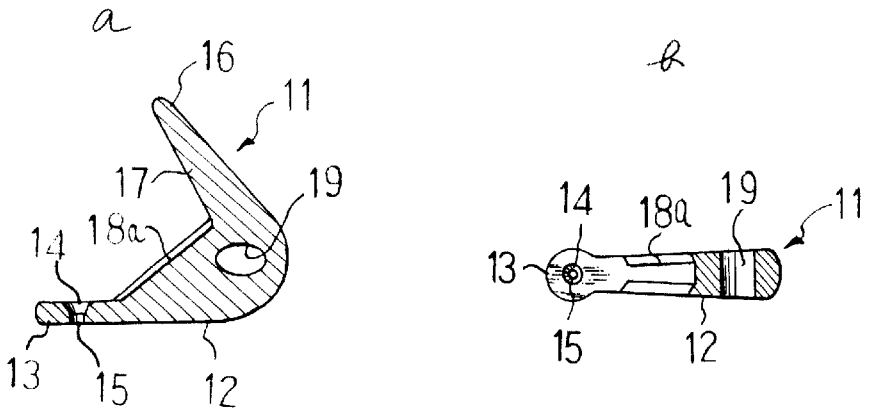
FIG. 5*a* is a cross-sectional view of the setting of FIG. 4.
FIG. 5*b* is A—A sectional view of the setting of FIG. 4.

FIG. 4 is a side view showing one embodiment of a setting of metallic parts 11 for setting a facet cut precious stone in this invention. FIG. Sa is the cross-sectional view of FIG. 4, and FIG. 5*b* is the A—A sectional view of FIG. 4. As shown in these figures, the setting of metallic parts 11 comprises a fundamental portion 12, a supporting face 18, an opening 19, a prong portion 17, a press prong 16, an inserting portion 13, and the setting metallic parts 11 is formed into a curving clip-shape. Because of its shape, the setting 11 can be used for any type of jewelry, such as a pendant, a ring, a pierced earring, an earring and others.

The prong portion 17 is formed into a projecting-shape, and a press prong 16 is equipped at the end of the prong portion 17. The prong portion 17 has a narrowed width so that the prong portion 17 can be easily bent along to the facet cut precious stone. When the prong portion 17 is bent along to the crown 51 and the table 52 of the facet cut precious stone 50, the prong portion 17 presses the facet cut precious stone 50 from above so as to be in pressure-contact.

The inserting portion 13 has a concave-recess 14 at the base surface where the culet 54 of the facet cut precious stone 50 is inserted. Also, the protecting hole 15 is formed substantially in the center of the concave-shape 14 for the protection of the point of the culet 54. The protecting hole 15 may be a through-hole, or be hollow-like.

The fundamental portion 12 diagonally rising from the inserting portion 13 is equipped with a supporting face 18 at its inner side which contacts the pavilion 53 of the facet cut precious stone 50. The supporting face 18 is formed as curved-surface 18*a* so that the pavilion 53 is supported in a stable manner.

In addition, an opening 19 is formed at the center of the fundamental portion 12, and is used for connecting with a jewelry body. For instance, a necklace chain is inserted when the setting of metallic parts 11 is used as a pendant, and a connecting ring is inserted when it is used as a ring.

Figure 6:
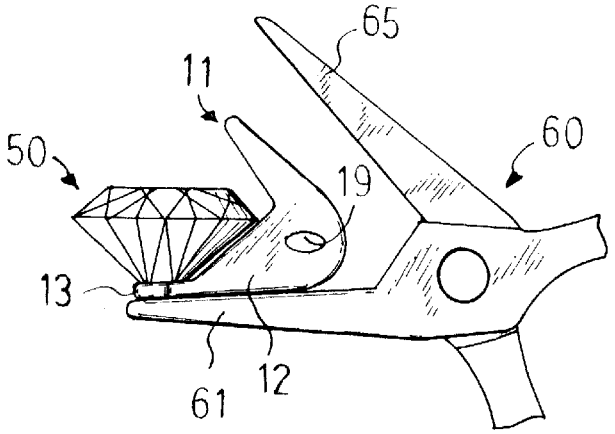
FIG. 6 is a side view showing a deforming process for one embodiment of the setting of metallic parts in this invention.
Figure 7:
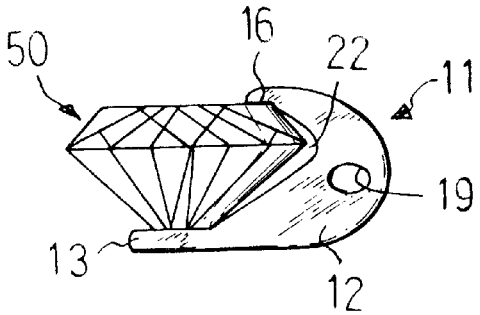
FIG. 7 is a side view showing one embodiment of the setting metallic parts after a deforming process in this invention.

FIG. 6 is a side view showing a deforming process of the setting of metallic parts 11 with a facet cut precious stone 50 in this invention, and FIG. 7 is a side view showing the setting of metallic parts 11 with a facet cut precious stone 50 after the deforming process.

The culet 54 is inserted into the protecting hole 15 of the fundamental portion 12, and then the prong portion 17 and the fundamental portion 12 are pushed in a downward direction by using the jewelry making tools such as pliers 60. In this process, the setting of metallic parts 11 is deformed by using its elastic nature, and the curving clip-shape may be closed.

Firstly, the lower part of the prong portion 17 contacts to the crown 51 of the facet cut precious stone 50 and presses the crown 51. Secondly, the press prong 16 is bent along the angle of the crown 51 when pushed more strongly, and it finally contacts the table 52 and presses the table 52 from above.

Since the fundamental portion 12 is formed in a half-round-shape at the outer side, even after the setting of metallic parts 11 is elastically deformed, it keeps it's design beautiful.

Since the angle between the girdle and the crown is generally smaller than the angle between the girdle and the pavilion in the usual proportion of the facet cut precious stone, it's possible that the facet cut precious stone 50 will be held by the prong portion 17 and the inserting portion 13 after the setting metallic parts 11 is deformed. However, a gap 22 still remains between the facet of the facet cut precious stone 50 and the pressure-contact surface of the setting of metallic parts 11.

Figure 8:
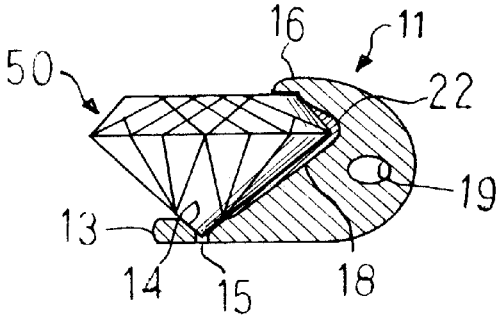
FIG. 8 is a cross-sectional view showing a soldering process of one embodiment of a setting of metallic parts in this invention.

FIG. 8 is a side view showing a soldering process of the setting of metallic parts 11 in this invention. Firstly, a flux, such as way sand, is coated to the setting 11 and the surface of the facet cut precious stone 50 so that the melting solder may flow into the gap 22 smoothly. The coated flux also serves as protection for the facet cut precious stone 50, and prevents it from being harmed by the high temperature of the heated solder. In addition, a Green Stop off (a brand name, Tokyo Blaze Ltd. in Japan) is coated to the rest of the pressure-contact surface of the setting of metallic parts 11 and stops the effusion of the dissolved solder.

Secondly, the setting of metallic parts 11 is heated for several minutes by using a burner or by placing the setting in a heated oven. The material of the setting of metallic parts 11 undergoes a thermal expansion, and the gap 22 is also enlarged a little at this moment. Then the linear precious metal solder is touched to the pressure-contact surface of the setting of metallic parts 11 in the vicinity of the gap 22. The precious metal solder dissolves by the heat of the setting of metallic parts 11, and the dissolved solder flows into the gap 22. The setting metallic parts 11 will then be placed for several minutes in the air and is cooled.

The precious metal solder inside of the gap 22 solidifies, and the setting of metallic parts 11 shrinks to its size before it was heated.

Because of the solidified solder filled in the gap 22 and the shrink of the setting of metallic parts 11, the pressure-contact surface of the setting of metallic parts 11 closely contacts the face of the facet cut precious stone 50, and the facet cut precious stone 50 is firmly held by the prong portion 17 and the inserting portion 13.

For finishing, the setting metallic parts 11 is soaked for several seconds in oxidation-treatment agents, such as a sulfuric acid. By this treatment, the flux and the Green Stop off coated on the facet setting metallic parts 11 and the facet cut precious stone 50 are washed away.

For soldering, the heating temperature of the setting of metallic parts 11 must be lower than the melting point of the material of the setting of metallic parts 11. For instance, in the case of 18 carat gold, the heating temperature of the setting of metallic parts 11 must stay below 750 degrees C. Naturally, the heating temperature must also be lower than the melting point of the facet cut precious stone 50. For instance, in the case of a diamond, the heating temperature of the facet cut precious stone 50 must be lower than 830 degrees C. For that reason, even the precious metal solder is available in several grades for the same material, and it's desirable to use the solder which dissolves at the lowest temperature possible. For instance, in the case of a platinum alloy material Platinum E solder (a brand name, Ijima Precious Metal Ltd. in Japan) is recommended. In the case of a gold alloy material, K10 solder (a brand name, Ijima Precious Metal Ltd. in Japan) is recommended.

When soldering, because of the function of the so-called capillary phenomenon, the solder only flows into the gap 22 and it does not flow out onto the surface of the facet cut precious stone 50. In other words, the precious metal solder is used for a different purpose than the usual use of the precious metal solder in this invention. In other words, it is not used for joining the precious metals, but for filling the gap 22.

In addition, the precious metal solder does not flow out all over the setting of metallic parts 11 due to the Green Stop off. Therefore, the polishing process of the setting metallic parts 11 is not difficult after the soldering process of this invention.

Moreover, the precious-metal solder for jewelry is usually made from precious-metal material which has a lower purity than the precious-metal itself, such as a gold alloy and a platinum alloy. Consequently, the appearance of the color is the same for both the setting of metallic parts 11 and for the precious metal solder. Thus, the value of the setting metallic parts 11 is not damaged by the soldering of this invention.

The setting of metallic parts 11 for the facet cut precious stone 50 can be manufactured using a press cutting process, a casting process, and other jewelry making processes.

Figure 9:
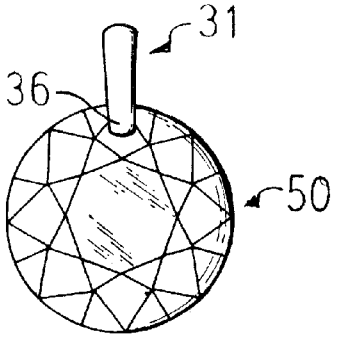
FIG. 9 is a plan view showing one embodiment of a setting of metallic parts having a prong portion contacting only the crown of the facetted precious stone in this invention.
Figure 10:
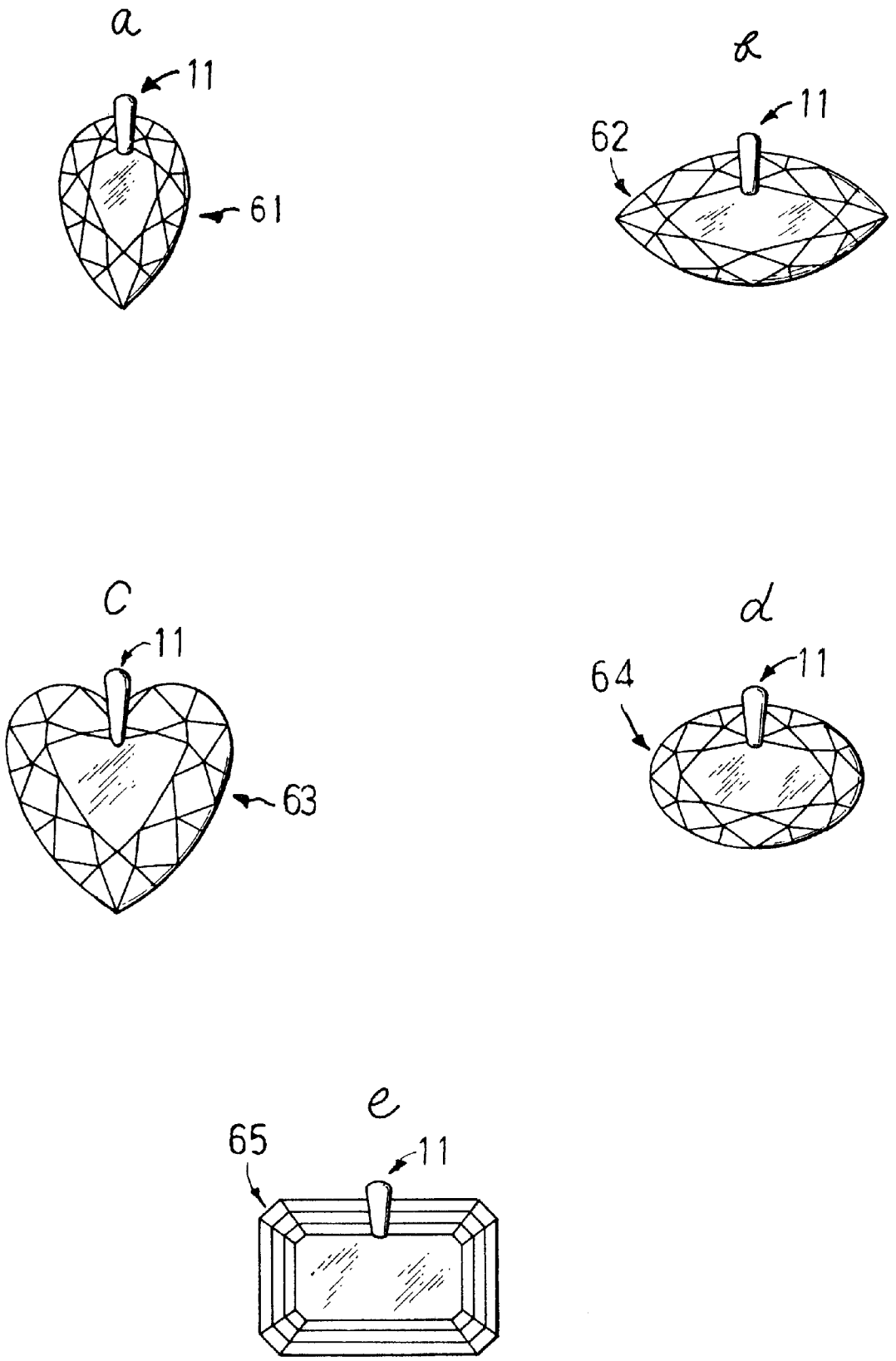
FIG. 10*a*, FIG. 10*b*, FIG. 10*c*, FIG. 10*d*, and FIG. 10*e* are plan views showing the various facetted cut precious stones held by the setting of metallic parts in this invention.

In this invention, various modifications are possible, and the claims are not limited to the above description. For instance, the length of the prong portion 17 may be adjusted by the proportion of the cutting of the facet cut precious stone 50 and by the balance of the design of the setting of metallic parts 11. Consequently, as shown in FIG. 9, the setting of metallic parts 31 having the press prong 36 which presses only against the crown of the facet cut precious stone 50 can be manufactured and brought into close contact with the stone 50 in this invention.

Still further, the setting of metallic parts 11 for setting the various facet cut styles of the precious stones, other than a so-called round brilliant cut, can be manufactured by this invention. For instance, as shown in FIG. 10*a*, FIG. 10*b*, FIG. 10*c*, FIG. 10*d* and FIG. 10*e*, the setting of metallic parts for the facet cut precious stone of the pear shape cut 61, the marquis cut 62, the heart shape cut 63, the oval mixed cut 64, the emerald cut 65, and other various cuts can be manufactured by this invention.

Employing the setting of metallic parts for setting the facet cut precious stone, and the method of setting a facet cut precious stone using the setting of metallic parts according to this invention, it is possible to bring the setting of metallic parts into close contact with the facet cut precious stone. This is because the gap between the facet of the facet cut precious stone and the pressure-contact surface of the prong portion is filled with the solidified precious metal solder. Thus, the facet cut precious stone does not fall off when some accident happens and some pulling-apart force is added since the flattened prong portion with the solidified solder is not easily opened.

Moreover, the correction work to eliminate the gap between the facet of the facet cut precious stone and the pressure contact-surface of the setting of metallic parts is not needed. Furthermore, the jewelry making tools used in this invention, such as the precious metal solder, the flux, the pliers and the burner, etc. are prepared for usual jewelry making process. Thus, this invention has an advantage in the actual operations.

It should be understood that the foregoing relates to only a preferred embodiment of the present invention, and that it is intended to cover all changes and modifications of the embodiment of the invention herein used for the purpose of the disclosure. These changes do not constitute departures from the spirit and scope of the invention.

What is claimed is:

1. A jewelry article comprising:

a precious stone including an upper half and a lower half, said upper half including a planar top and a crown having a plurality of side facets, said lower half including a pavilion having a plurality of side facets and a culet at a tip of said pavilion;

a metallic setting holding said precious stone, said setting including a single prong portion pressing at least one of said top and said crown of said precious stone, and a single inserting portion having a concave recess pressing said culet of said precious stone; and a thermoplastic agent disposed between said prong portion and said precious stone, said thermoplastic agent being heated and dissolved so as to flow between said prong portion and said precious stone and subsequently cooled, whereby said metallic setting tightly holds said precious stone.

2. The jewelry article of claim 1, wherein said thermoplastic agent comprises precious metal solder.

3. The jewelry article of claim 1, wherein said precious stone has one of a group of shapes consisting of: a pear truncated pyramid-shaped crown and a pear truncated pyramid-shaped pavilion; a marquis truncated pyramid-shaped crown and a marquis truncated pyramid-shaped pavilion; a heart truncated pyramid-shaped crown and a heart truncated pyramid-shaped pavilion; and an oval truncated cone-shaped crown and an oval truncated cone-shaped pavilion.

4. The jewelry article of claim 3, wherein said thermoplastic agent comprises precious metal solder.

5. The jewelry article of claim 1, wherein said prong portion has a width lesser than a width of said inserting portion.

6. The jewelry article of claim 1, wherein said setting is formed as a single, unitary component.

7. The jewelry article of claim 1, wherein said precious stone includes a plurality of sides, and said setting holds said precious stone at only one of said sides.

* * * * *